US006743557B2

(12) United States Patent
Omokawa

(10) Patent No.: US 6,743,557 B2
(45) Date of Patent: Jun. 1, 2004

(54) POSITIVE CHARGING SINGLE-LAYER ORGANIC PHOTORECEPTOR FOR LIQUID DEVELOPMENT

(75) Inventor: Shinichi Omokawa, Matsumoto (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 10/212,812

(22) Filed: Aug. 7, 2002

(65) Prior Publication Data

US 2003/0134213 A1 Jul. 17, 2003

(30) Foreign Application Priority Data

Aug. 9, 2001 (JP) ..... P.2001-242474

(51) Int. Cl.[7] ..... G03G 5/07
(52) U.S. Cl. ..... 430/96; 430/58.7; 430/59.6
(58) Field of Search ..... 430/96, 58.7, 59.6

(56) References Cited

U.S. PATENT DOCUMENTS 6,316,577 B1 * 11/2001 Shimada et al. ..... 528/196
6,593,047 B2 * 7/2003 Azuma et al. ..... 430/96
6,599,671 B2 * 7/2003 Mitsumori et al. ..... 430/96

FOREIGN PATENT DOCUMENTS

JP 9-127713 5/1997
JP 2000-214610 8/2000

* cited by examiner

*Primary Examiner*—John Goodrow
(74) *Attorney, Agent, or Firm*—Sughrue Mion, PLLC

(57) ABSTRACT

Disclosed is a positive charging single-layer organic photoreceptor for liquid development which comprises a conductive substrate having thereon a photosensitive layer containing a charge generating material, an electron transport material and an organic binder resin comprising a polymer represented by formula (I):

(I)

wherein $R_1$ and $R_2$ each represent a substituted or unsubstituted alkyl group or a substituted or unsubstituted aryl group, or $R_1$ and $R_2$ may form a cycloalkyl group in combination; $R_3$, $R_4$, $R_5$, $R_6$, $R_7$, $R_8$, $R_9$, $R_{10}$ and $R_{11}$, each represent a hydrogen atom, a halogen atom, an aryl group or an alkyl group; and m and n each represent a molar percentage giving a total of 70 to 95 mol %.

7 Claims, 1 Drawing Sheet

POSITIVE CHARGING SINGLE-LAYER ORGANIC PHOTORECEPTOR FOR LIQUID DEVELOPMENT

FIELD OF THE INVENTION

This invention relates to a positively working single-layer organic photoreceptor which can be mounted on high-resolution electrophotographic equipment of liquid (or wet) development system.

BACKGROUND OF THE INVENTION

Electrophotographic image-forming apparatus have been widely spreading chiefly in offices as printers, copiers, facsimiles, etc. for their capability of high speed processing and high image quality.

Broadening of application of the electrophotographic image-forming techniques particularly in the fields of instruments having color output capability and light-duty printers has been of recent interest. Accordingly, electrophotographic image-forming technology realizing high resolution, high gradient and high speed has been being actively researched and developed, and market development of image-forming apparatus reflecting the results of the researches and developments is being undertaken.

Coping with such a market trend, improvements along the researches and developments have been added to a photoreceptor, which may be said to be the heart of this type of image-forming apparatus, particularly an organic photoreceptor.

This kind of organic photoreceptors are roughly divided into layered or dual-layer ones comprising a charge generating layer (CGL) having a charge generation function and a charge transport layer (CTL) having a charge transport function and single-layer ones having a photosensitive layer having both a charge generation function and a charge transport function.

The former type of organic photoreceptors comprise a cylindrical conductive substrate made of aluminum, etc. on which a CGL and a CTL are stacked in this order. Their application is generally limited to negatively charging image-forming apparatus in nature of the organic material. The latter type construction comprises a cylindrical conductive substrate of aluminum, etc. on which a single-ply photosensitive layer is provided and is mainly applied to positively charging image-forming apparatus which, in principle, easily provide high resolution.

When a semiconductor laser having a wavelength of 700 to 800 nm or a light-emitting diode having a wavelength of 600 to 700 nm is used as an exposure light source, both the single-layer and the layered photoreceptors often contain such photoconductive materials as phthalocyanine compounds, particularly metal-free phthalocyanine pigments and titanyl phthalocyanine pigments as a charge generating material (CGM).

Layered photoreceptors of separate function type in which a CTL is superposed on a CGL have been widely put into practical use for their electrophotographic characteristics and durability. However, because the CTL used in this type of photoreceptors chiefly contains a hole transport material (HTM) by material limitation, most of these photoreceptors adopt a negative charging layer configuration fit for negative charging electrophotographic processing.

Compared with positive corona discharge, negative corona discharge used in negative charging image-forming apparatus is less stable and generates more ozone, the powerful oxidizing action of which gives adverse influences to the photoreceptor and the working environment.

While a positive charging system generating less ozone is an effective choice to solve these problems, a positive charging organic photoreceptor required for this system is generally less sensitive than negative charging organic photoreceptors. Therefore, a positive charging organic photoreceptor with high sensitivity has been sought for. Because a positive charging photoreceptor has the charge generating function predominantly in the vicinity of its surface, the distance of electrons' movement to the photoreceptor surface necessary to form an electrostatic latent image is shorter than that in a negative charging photoreceptor. As a result, a positive charging photoreceptor is characterized by high resolution.

Various layer configurations have been proposed for a photosensitive layer of a positive charging photoreceptor, including a layered type having a CGL on a hole transport layer (HTL) and a single-layer type having a layer containing both a charge generating material (CGM) and a charge transport material (CTM). Positive charging layered type photoreceptors are behind negative charging layered type photoreceptors in practical application because they have a thin CGL on their surface and therefore involve the problem of poor durability. Positive charging single-layer photoreceptors tend to be inferior to negative charging layered photoreceptors in electric characteristics such as sensitivity as stated above. This problem is due to because none of the available electron transport materials (ETMs) is equal or superior to available hole transport materials (HTMs) in mobility.

In recent years, a large number of ETMs and electrophotographic photoreceptors using them which deserve attention have been proposed or reported in JP-A-1-206349, JP-A-4-360148, Denshi Shashin Gakkaishi, vol. 30 (1991), pp. 266–273, JP-A-3-290666, JP-A-5-92936, Proceedings of Pan-Pacific Imaging Conference/Japan Hardcopy '98, Jul. 15–17th, 1988, JA Hall, Tokyo, Japan, pp. 207–210, JP-A-9-151157, Proceedings of Japan Hardcopy '97, Jul. 9–11th, 1998, JA Hall, Tokyo, Japan, pp. 21–24, JP-A-5-279582, JP-A-7-179775, Proceedings of Japan Hardcopy '92, July 6–8th, JA Hall, Tokyo Japan, pp. 173–176, and JP-A-10-73937.

Further, single-layer photoreceptors having a combination of the HTM and the ETM disclosed in JP-A-5-150481, JP-A-6-130688, JP-A-9-281728, JP-A-9-281729, and JP-A-10-239874 have been noted for their high sensitivity, and part of them have been put to practical use.

On the other hand, electrophotographic apparatus are classified according to the development system into those for dry development and those for wet (liquid) development. The wet development system uses a liquid developer comprising charged toner particles dispersed in a dielectric medium, usually a petroleum isoparaffinic solvent such as Isopar (available from Exxon Chemicals). A photoreceptor having thereon an electrostatic latent image formed by exposure processing is dipped in or brought into contact with the liquid developer. Whereupon, the toner is electrophoretically adhered to the latent image in an electric field produced between the photoreceptor and a separately provided development electrode thereby to visualize the latent image. The toner used in the liquid development system has a smaller particle size (0.1 to 1 $\mu$m) than that used in the dry development system (3 to 10 $\mu$m) and a larger total surface area and thereby gains greater toner charge. As a result, toner image disturbances hardly occur, and the edge effect is reduced. Thus, the liquid development system is characterized by providing images of high resolution and good gradation reproduction and is particularly suitable for full color image formation.

Since the photoreceptor is dipped in a petroleum paraffinic solvent as mentioned above, the photosensitive layer must be resistant to this solvent. Because organic photoreceptors generally used in dry development are not sufficiently resistant to the solvent of this kind, they would undergo not only considerable deterioration in appearance but elution of the CTM dispersed therein into the solvent, resulting in serious reduction of electrical and optical characteristics. Therefore, inorganic photoconductive substances such as selenium and amorphous silicon have been of frequent use to make a solvent-resistant photoreceptor for use in the liquid development system.

With the recent development of organic photoreceptors, a solvent-resistant photoreceptor comprising a poly(2,6-dimethoxyanthracene-9,10-diol alkanedicarboxylic acid ester) resin has been proposed in JP-A-4-358157. The proposed photoreceptor is a negative charging layered photoreceptor having a solvent-resistant overcoat. The problem of harmful ozone generation due to negative corona discharge is still involved. It has therefore been keenly demanded to develop a positive charging single-layer photoreceptor that can be used in liquid development.

JP-A-2000-214610 discloses a positive charging single-layer photoreceptor format for wet development which has no overcoat and yet exhibits high resistance to Isopar, a main carrier medium used in wet development, involves little elution of the CTM, and exhibits high sensitivity for practical use. According to the present inventors' investigation, however, the proposed photoreceptor cannot be seen as satisfactory in terms of sensitivity enough to meet the market demand, still leaving room for further improvement.

JP-A-2000-63456 discloses a positive charging single-layer photoreceptor for wet development which is free from deterioration by solvent and elution of the CTM into solvent, wherein a copolymer of a block having a chemical structure with a charge transport function and a block having a chemical structure as a binder resin is used. However, the sensitivity of the proposed single-layer photoreceptor cannot be necessarily seen as sufficiently high as to fulfill the market demand.

JP-A-5-230202 proposes a polycarbonate copolymer and an electrophotographic photoreceptor comprising the same. The polycarbonate copolymer comprises a diarylene vinylene arylene skeleton as a repeating unit and has a charge transport function. The disclosure refers to use of the polycarbonate copolymer in a single-layer photoconductive layer. However, the object of the invention is to improve wear resistance and electrophotographic characteristics, and to solve the problems of photoreceptors for wet development is not necessarily aimed at. There is found no reference still less suggestion as to durability against Isopar, a main carrier medium for wet development. It is unclear from the disclosure whether or not a photoreceptor having the single-layer photoconductive layer reaches high sensitivity in wet development.

JP-A-9-127713 discloses, in Table 1, a distyrylamine-polycarbonate copolymer resin comprising a distyrylamine skeleton (serving as an HTM) and a polycarbonate unit bonded to the para-position of a phenylene group bonded to the tertiary amino group of the distyrylamine skeleton. Although the disclosure suggests that the resin is applicable to a single-layer photoreceptor shown in FIG. 2, it lacks experimental confirmation that the resin is effective in a single-layer photoreceptor as well in a wet development system, seeing that all the photoreceptors prepared in Examples 1 to 16 are layered photoreceptors.

SUMMARY OF THE INVENTION

An object of the present invention is to provide a positive charging single-layer organic photoreceptor which has high resistance to an isoparaffinic solvent, a petroleum solvent used in liquid development, undergoes little elution of a CTM into the solvent, and exhibits sufficiently high sensitivity for practical use.

Other objects and effects of the invention will be apparent from the following description.

The objects of the present invention have been achieved by providing:

(1) A positive charging single-layer organic photoreceptor for liquid development which comprises a conductive substrate having thereon a photosensitive layer containing a CGM, an ETM, and an organic binder resin comprising a polymer represented by formula (I):

(I)

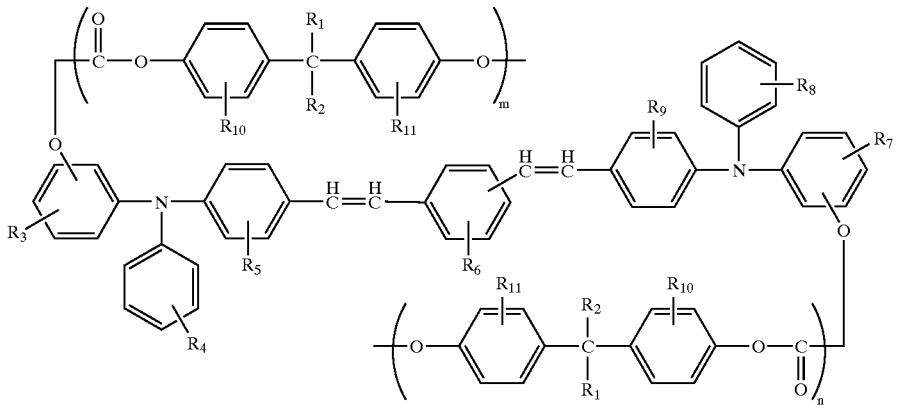

wherein $R_1$ and $R_2$ each represent a substituted or unsubstituted alkyl group or a substituted or unsubstituted aryl group, or $R_1$ and $R_2$ may form a cycloalkyl group in combination; $R_3$, $R_4$, $R_5$, $R_6$, $R_7$, $R_8$, $R_9$, $R_{10}$ and $R_{11}$ each represent a hydrogen atom, a halogen atom, an aryl group or an alkyl group; and m and n each represent a molar percentage giving a total of 70 to 95 mol %.

The present invention also provides the following preferred embodiments.

(2) The positive charging single-layer organic photoreceptor for liquid development according to item (1) above, wherein said photosensitive layer contains metal-free phthalocyanine.

(3) The positive charging single-layer organic photoreceptor for liquid development according to item (1) above, wherein said photosensitive layer contains titanyl phthalocyanine.

(4) The positive charging single-layer organic photoreceptor for liquid development according to any one of items (1) to (3) above, wherein said photosensitive layer contains a hole transport material.

(5) The positive charging single-layer organic photoreceptor for liquid development according to item (4) above, wherein the total content of said hole transport material and the component functioning for hole transport in said polymer represented by formula (I) is larger than the content of said electron transport material.

(6) The positive charging single-layer organic photoreceptor for liquid development according to any one of items (1) to (5) above, wherein said polymer represented by formula (I) is represented by formula (II), wherein m and n give a total of 80 to 90 mol %.

(II)

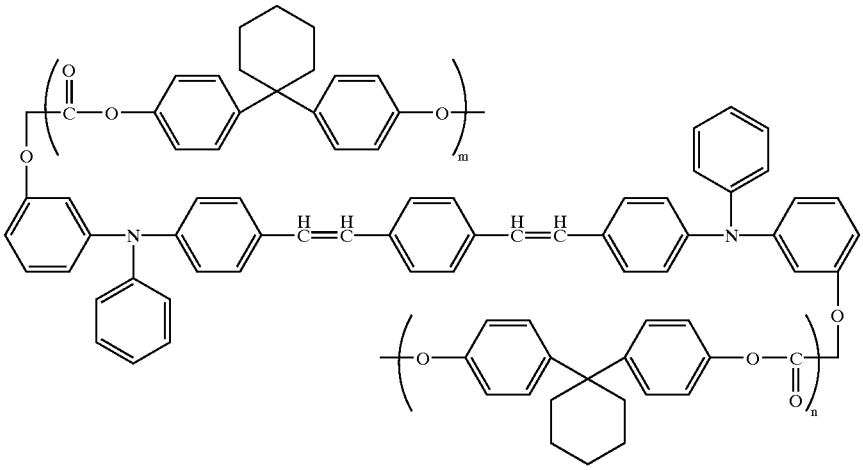

(7) The positive charging single-layer organic photoreceptor for liquid development according to any one of items (1) to (6) above, wherein the content of said polymer in said photosensitive layer is 70% by weight or more.

DETAILED DESCRIPTION OF THE INVENTION

The positive charging single-layer organic photoreceptor according to the present invention will be described in detail based on its preferred embodiments with reference to the accompanying drawings.

Figure 1:
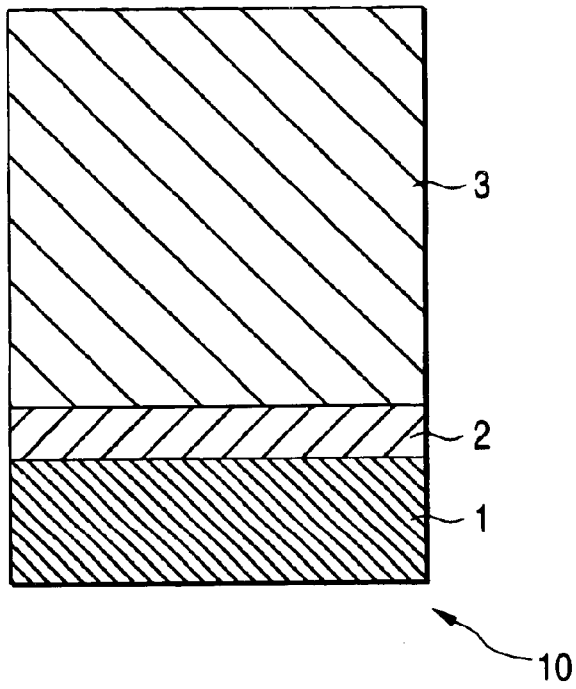
FIG. 1 is a schematic cross-section of the main part of the positive charging singly-layer organic photoreceptor for liquid development according to the present invention.

FIG. 1 is a schematic cross-section of the main part of the positive charging single-layer organic photoreceptor according to the present invention. The photoreceptor 10 shown in FIG. 1 comprises a cylindrical conductive substrate 1 and a single-layer photosensitive layer 3 provided on the substrate 1 via the primer coat 2. The primer coat 2 is an optional element which can be added according to necessity.

The cylindrical conductive substrate 1 serves as a photoreceptor electrode as well as a support for the photosensitive layer. Materials making the conductive substrate 1 include metals, such as aluminum, stainless steel, and nickel, and insulating materials, such as glass and plastics, having been rendered conductive by surface treatment. A cylindrical conductive substrate made of an aluminum-based metal is mostly used.

The primer coat 2 is generally a resin layer made mainly of a resin or a metal oxide film, such as anodized aluminum (Alumilite). The primer coat 2 includes one having a moderately controlled conductivity ($10^8$ to $10^{12}$ Ωcm) which is intended to control charge injection from the conductive substrate 1 to the photosensitive layer 3 and one having a high conductivity ($10^8$ Ωcm or lower in resistivity) which chiefly aims at performing the function as a conductive substrate. The primer coat 2 can perform additional functions, such as covering surface defects of the substrate and improving adhesion between the conductive substrate 1 and the photosensitive layer 3. Film-forming resin materials (binder resins) which can be used to form the primer coat 2 include insulating polymers, such as casein, polyvinyl alcohol, polyvinyl acetal, polyvinyl chloride, polyvinyl acetate, vinyl chloride-vinyl acetate copolymers, vinyl chloride-vinyl acetate-maleic anhydride copolymers, ethylene-vinyl acetate copolymers, polyamide resins, polyester resins, ethylene cellulose, carboxymethyl cellulose, nitrocellulose, polycarbonate resins, silicone resins, epoxy resins, urethane resins, and melamine resins; and conductive polymers, such as polythiophene, polypyrrole, and polyaniline. These binder resins can be used either individually or as an appropriate combination thereof. Particles of metal oxides, such as titanium oxide and zinc oxide, can be incorporated into the binder resin. The metal oxide particles may be treated to be rendered conductive or be surface-treated with an aminosilane, etc. to have improved dispersibility in the binder resin.

Where the primer coat 2 is one having high conductivity, another primer coat functioning for charge injection control may be provided thereon.

Apart from a primer coat of a metal oxide film, e.g., Alumilite, the primer coat 2 of a resin layer mainly comprising a binder resin is usually formed by coating the substrate 1 with a primer composition prepared by dissolving or dispersing a resin and other additives in at least one medium by dip coating. The primer coat 2 of a resin layer usually has a thickness of 0.01 to several tens of microns.

The photosensitive layer 3 of single-layer construction basically comprises a film-forming binder resin and a phthalocyanine compound as a CGM. The photosensitive layer 3 can further comprise adequate amounts of an HTM and an ETM as needed to control high-sensitivity characteristics. If desired, additives, such as antioxidants for protection from oxidation, agents for improving the smoothness of a photosensitive layer, and charge control agents, can be added to the photosensitive layer 3.

The present invention is characterized by using, as a binder resin, a copolymer comprising a unit having the chemical structure of a specific CTM for functioning as a CTM and a unit having the chemical structure of a polycarbonate resin.

The binder resin used in the invention is a copolymer composed of a distyrylamine compound known as an excellent CTM and a bisphenol type polycarbonate resin. The phenylene group in the middle of the distyrylamine skeleton and the phenylene group which is bonded to the tertiary amino group and to which the polycarbonate unit is bonded can be ortho-, meta- or para-form according to the bonding position. Meta-forms are preferred of them from the standpoint of solubility in dichloroethane, dichloromethylene or the like solvents and stability in a dissolved state.

If the viscosity average molecular weight thereof is below 40,000, the resulting photosensitive layer tends to have insufficient sensitivity for meeting the demand. The copolymer binder resin preferably has a viscosity average molecular weight of 60,000 to 100,000. Above 100,000 the coating composition tends to have too high thixotropy to be manageable in film thickness control.

Where the photosensitive layer contains 80% or more of the copolymer binder resin, it will keep resistant to a carrier medium (isoparaffinic solvent, e.g., Isopar) in 120 days' or longer immersion. With the copolymer content of 70% the photoreceptor will have resistance of about one week. With the copolymer content less than 70%, the elution will become marked and the resistance will be reduced to about one day. Accordingly, the copolymer binder resin content in the photosensitive layer is preferably 70% or more, still preferably 80% or more.

The copolymer of formula (I) where the total of m and n is less than 70% is difficult to synthesize. Where (m+n) exceeds 95%, the proportion of the component performing the charge transport function is so small that the reduction in hole transport function should be compensated for by separately adding an appreciable amount of an HTM to attain high sensitivity. It would follow considerable elution of the HTM into the carrier medium (e.g., Isopar), which tends to lead to noticeable changes in characteristics after repeated use. The total of m and n is preferably from 80 to 90 mol %.

The polycarbonate copolymer resin of the present invention can be synthesized by the process described in JP-A-5-230202 and JP-A-9-127713 supra.

It is a preferred manipulation to add an HTM to the photosensitive layer to assure high sensitivity. Any organic materials that show high hole mobility in a prescribed electric field can be used as an HTM. Such organic materials include hydrazones, pyrazolines, pyrazolones, butadienes, oxadiazoles, arylamines, benzidines, stilbenes, styryls, polyvinylcarbazoles, and polysilanes. These HTMs can be used either individually or as a combination of two or more thereof.

It is desirable that the HTM used in the invention be satisfactory in not only hole transport capability but also relative ionization potential where combined with a CGM. The HTM is usually used in an amount of 0 to 35%, preferably 0 to 25%, by weight based on the photosensitive layer.

Any organic material that has high electron mobility in a prescribed electric field can be used as an ETM. Examples of useful ETMs (electron acceptor compounds) include chloranil, bromanil, tetracyanoethylene, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyranes, quinones, benzoquinones, diphenoquinones, naphthoquinones, anthraquinones, stilbenequiones, and azoquinones. These ETMs can be used either individually or as a combination of two or more thereof. The ETM is usually used in an amount of 1 to 40%, preferably 5 to 30%, by weight based on the photosensitive layer.

The present invention will be illustrated in greater detail with reference to the following Examples and Comparative Examples, but the invention should not be construed as being limited thereto. All the "%" and "part" are given by weight unless otherwise indicated.

EXAMPLE 1

A photoreceptor drum of 30 mm in diameter and 325 mm in length was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 $\mu$m.

| Formulation: | |
|---|---|
| CGM: X-form metal-free phthalocyanine of formula (5) | 1 part |
| ETM: compound of formula (6) | 15 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: distyrylamine-bisphenol Z polycarbonate copolymer resin represented by formula (II) (viscosity-average molecular weight: 70,000; 100 − (m + n) = 15 mol % (28.4 wt %), available from Idemitsu Kosan Co., Ltd.) | 80 parts |
| Solvent: dichloromethylene/dichloroethane (7/3) | 900 parts |

In the above formulation, the ETM accounts for 15% of the solids content. The hole-transport functioning block in the copolymer resin substantially accounts for 22.7% (=28.4%×0.8) of the solids content.

(5)

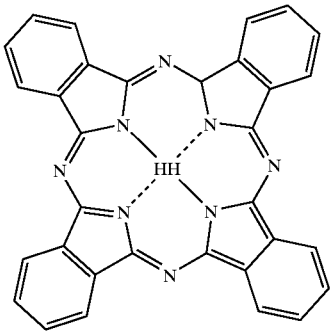

-continued (6)

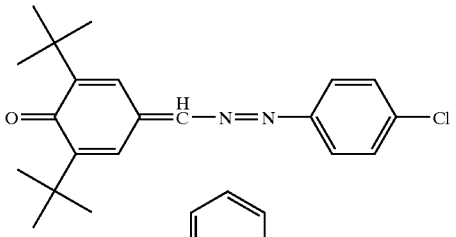

(7)

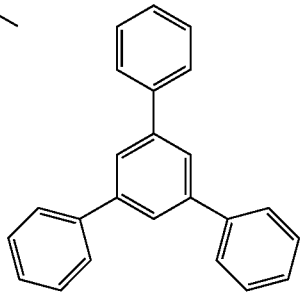

(8)

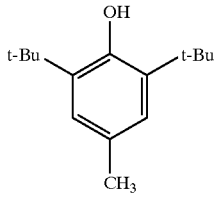

EXAMPLE 2

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 μm.

| Formulation: | |
|---|---|
| CGM: X-form metal-free phthalocyanine of formula (5) | 1.5 parts |
| ETM: compound of formula (6) | 15 parts |
| HTM: compound of formula (9) | 9.5 parts |
| Charge control agent: compound of formula (7) | 3 parts |

-continued

| Formulation: | |
|---|---|
| Antioxidant: BHT of formula (8) | 1 part |
| Silicone oil: KF-54, available from Shin-Etsu Chemical Co., Ltd. | 0.15 part |
| Binder resin: distyrylamine-bisphenol Z polycarbonate copolymer resin represented by formula (II) (viscosity-average molecular weight: 70,000; 100 − (m + n) = 15 mol % (28.4%), available from Idemitsu Kosan Co., Ltd.) | 70 parts |
| Solvent: dichloromethylene/dichloroethane (7/3) | 900 parts |

In the above formulation, the ETM accounts for 15% of the solids content. The substantial weight ratio of the total content of the HTM and the block functioning for hole transport in the copolymer resin is 29.4% (=28.4%×0.7+9.5%) to the total solids content.

(9)

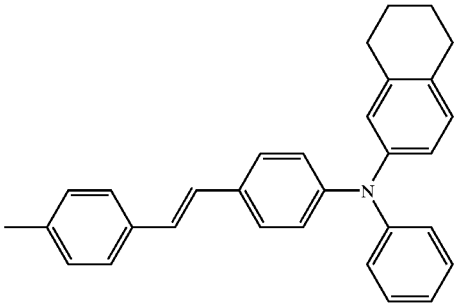

EXAMPLE 3

A positive charging single-layer organic photoreceptor for liquid development was prepared in the same manner as in Example 1, except for replacing the binder resin with a distyrylamine-bisphenol Z polycarbonate copolymer resin represented by formula (II-1) shown below (viscosity-average molecular weight: 70,000; 100−(m+n)=15 mol % (28.4%)). The copolymer resin of formula (II-1) is different from the resin of formula (II) used in Example 1 in that the polycarbonate unit is bonded to the ortho-position of the phenylene group bonded to the tertiary amino group of the distyrylamine skeleton.

(II-1)

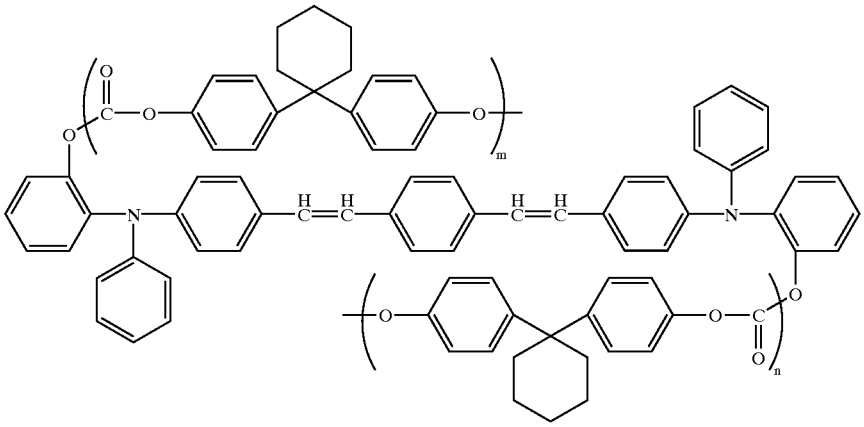

EXAMPLE 4

A positive charging single-layer organic photoreceptor for liquid development was prepared in the same manner as in Example 1, except for replacing the binder resin with a distyrylamine-bisphenol z polycarbonate copolymer resin represented by formula (II-2) shown below (viscosity-average molecular weight: 70,000; 100−(m+n)=15 mol % (28.4%)). The copolymer resin of formula (II-2) is different from the resin of formula (II) used in Example 1 in that the polycarbonate unit is bonded to the para-position of the phenylene group bonded to the tertiary amino group of the distyrylamine skeleton.

EXAMPLE 5

A positive charging single-layer organic photoreceptor for liquid development was prepared in the same manner as in Example 1, except for replacing the binder resin with a distyrylamine-bisphenol Z polycarbonate copolymer resin represented by formula (II-3) shown below (viscosity-average molecular weight: 70,000; 100−(m+n)=15 mol % (28.4%)). The copolymer resin of formula (II-3) different from the resin of formula (II) used in Example 1 in that the phenylene group in the middle of the distyrylamine skeleton is an m-phenylene group.

(II-2)

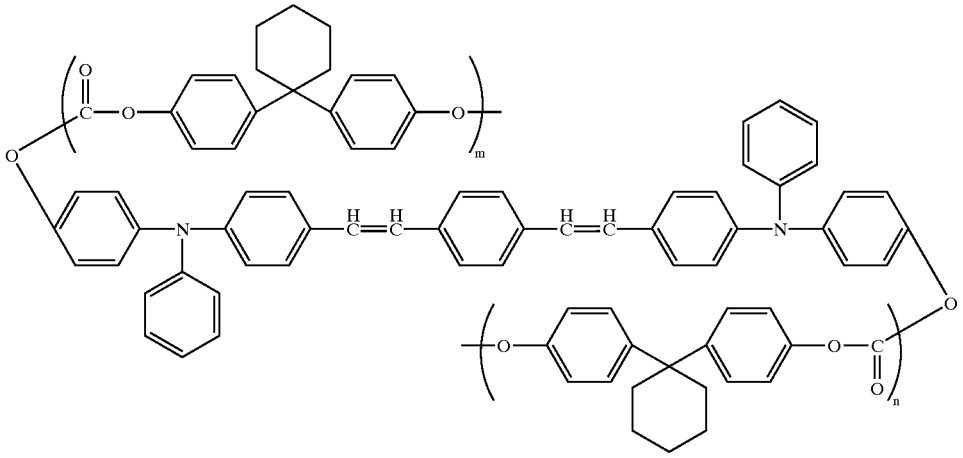

(II-3)

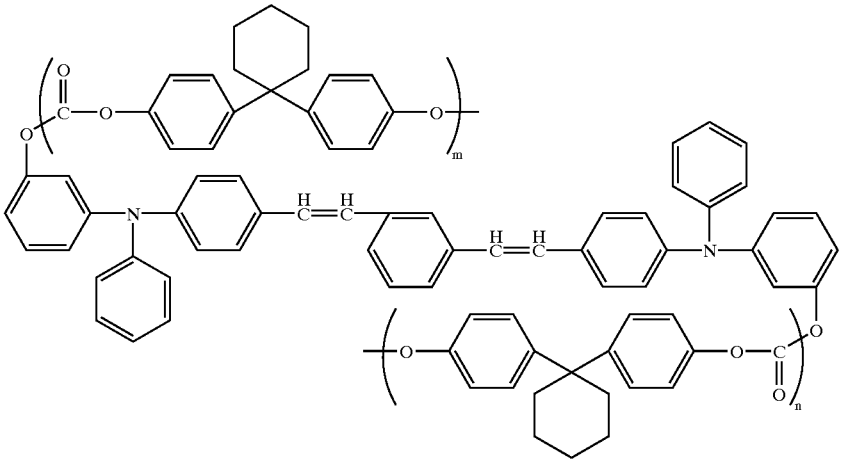

EXAMPLE 6

A positive charging single-layer organic photoreceptor for liquid development was prepared in the same manner as in Example 1, except for replacing the binder resin with a distyrylamine-bisphenol Z polycarbonate copolymer resin represented by formula (II-4) shown below (viscosity-average molecular weight: 70,000; 100−(m+n)=15 mol % (28.4%)). The copolymer resin of formula (II-4) is different from the resin of formula (II) used in Example 1 in that the phenylene group in the middle of the distyrylamine skeleton is an o-phenylene group.

Example 1, except for replacing the binder resin with a distyrylamine-bisphenol Z polycarbonate copolymer resin represented by formula (II) having a viscosity-average molecular weight of 70,000 in which 100−(m+n)=30 mol % (56.7%).

In the formulation of the photosensitive layer coating composition, the ETM accounts for 15% of the solids content. The hole-transport functioning block in the copolymer resin substantially accounts for 45.36% (=56.7%×0.8) of the solids content.

(II-4)

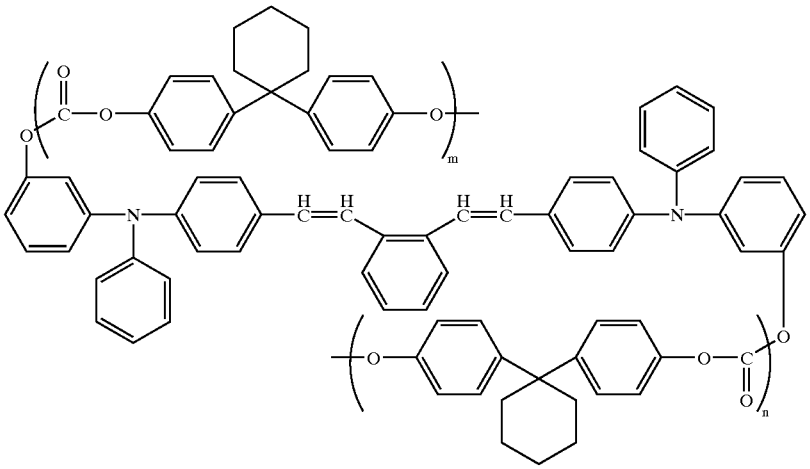

EXAMPLE 7

A positive charging single-layer organic photoreceptor for liquid development was prepared in the same manner as in Example 2, except for replacing the binder resin with a distyrylamine-bisphenol Z polycarbonate copolymer resin represented by formula (II) having a viscosity-average molecular weight of 70,000 in which 100−(m+n)=5 mol % (9.45%).

In the formulation of the photosensitive layer coating composition, the ETM accounts for 15% of the solids content. The substantial weight ratio of the total content of the HTM and the block functioning for hole transport in the copolymer resin is 16.11% (=9.45%×0.7+9.5%) to the total solids content.

EXAMPLE 8

A positive charging single-layer organic photoreceptor for liquid development was prepared in the same manner as in Example 1, except for replacing the binder resin with a distyrylamine-bisphenol Z polycarbonate copolymer resin represented by formula (II) having a viscosity-average molecular weight of 70,000 in which 100−(m+n)=10 mol % (18.9%).

In the formulation of the photosensitive layer coating composition, the ETM accounts for 15% of the solids content. The hole-transport functioning block in the copolymer resin substantially accounts for 15.12% (=18.9%×0.8) of the solids content.

EXAMPLE 9

A positive charging single-layer organic photoreceptor for liquid development was prepared in the same manner as in

COMPARATIVE EXAMPLE 1

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 μm.

| Formulation: | |
|---|---|
| CGM: X-form metal-free phthalocyanine of formula (5) | 1.5 parts |
| ETM: compound of formula (6) | 25 parts |
| HTM: compound of formula (9) | 9.5 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: distyrylamine-bisphenol Z polycarbonate copolymer resin represented by formula (II) (100 − (m + n) = 15 mol % (28.4%), available from Idemitsu Kosan Co., Ltd.) | 60 parts |
| Solvent: dichloromethylene/dichloroethane (7/3) | 900 parts |

In the above formulation, the ETM accounts for 25% of the solids content. The substantial weight ratio of the total content of the HTM and the hole transport block in the copolymer resin is 26.5% (=28.4%×0.6+9.5%) to the total solids content.

COMPARATIVE EXAMPLE 2

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 μm. The binder resin used in the formulation is a well-known polycarbonate resin represented by formula (10) shown below.

| Formulation: | |
|---|---|
| CGM: X-form metal-free phthalocyanine of formula (5) | 1.5 parts |
| ETM: compound of formula (6) | 25 parts |
| HTM: compound of formula (9) | 24.5 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: bisphenol Z polycarbonate resin represented by formula (10) (Panlite TS2050, available from Teijin Chemicals Ltd.) | 45 parts |
| Solvent: dichloromethylene/dichloroethane (7/3) | 900 parts |

(10)

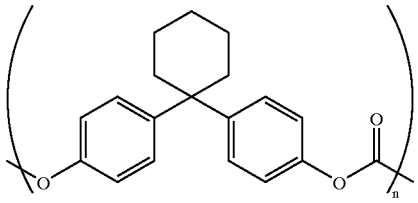

COMPARATIVE EXAMPLE 3

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to form a positive charging organic photoreceptor for liquid development having a single-layer type photosensitive layer with a thickness of 25 μm. The binder resin used in the formulation is a well-known polycarbonate resin represented by formula (10).

| Formulation: | |
|---|---|
| CGM: X-form metal-free phthalocyanine of formula (5) | 1.5 parts |
| ETM: compound of formula (6) | 15 parts |
| HTM: compound of formula (9) | 24.5 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: bisphenol Z polycarbonate resin represented by formula (10) (Panlite TS2050, available from Teijin Chemicals Ltd.) | 55 parts |
| Solvent: dichloromethylene/dichloroethane (7/3) | 900 parts |

COMPARATIVE EXAMPLE 4

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 μm. The binder resin used in the formulation is a well-known polycarbonate resin represented by formula (10).

| Formulation: | |
|---|---|
| CGM: X-form metal-free phthalocyanine of formula (5) | 1.5 parts |
| ETM: compound of formula (6) | 10 parts |
| HTM: compound of formula (9) | 14.5 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: bisphenol Z polycarbonate resin represented by formula (10) (Panlite TS2050, available from Teijin Chemicals Ltd.) | 70 parts |
| Solvent: dichloromethylene/dichloroethane (7/3) | 900 parts |

COMPARATIVE EXAMPLE 5

A photoreceptor drum of 30 mm in diameter was prepared as follows for Isopar immersion test evaluation.

The formulation shown below was thoroughly dispersed in a mill to prepare a dispersion. An aluminum pipe was dipped in the dispersion and dried at 100° C. for 60 minutes to obtain a positive charging organic photoreceptor for liquid development having a single-layer type photosensitive layer with a thickness of 25 μm. The binder resin used in the formulation is a well-known polycarbonate resin represented by formula (10).

| Formulation: | |
|---|---|
| CGM: X-form metal-free phthalocyanine of formula (5) | 1.5 parts |
| ETM: compound of formula (6) | 5 parts |
| HTM: compound of formula (9) | 9.5 parts |
| Charge control agent: compound of formula (7) | 3 parts |
| Antioxidant: BHT of formula (8) | 1 part |
| Silicone oil: KF-54, available from Shin-Etsu Chemical Co., Ltd. | 0.15 part |
| Binder resin: bisphenol Z polycarbonate resin represented by formula (10) (Panlite TS2050, available from Teijin Chemicals Ltd.) | 80 parts |
| Solvent: dichloromethylene/dichloroethane (7/3) | 900 parts |

The photoreceptors prepared in Examples 1 to 9 and Comparative Examples 1 to 5 were evaluated as described below. The results of evaluation are shown in Tables 1 and 2. When the same test was carried out on photoreceptors prepared in the same manner, except for replacing X-form metal-free phthalocyanine as a CGM with titanyl phthalocyanine, equivalent results were obtained.

Measurement and Testing Conditions

Figure 2:
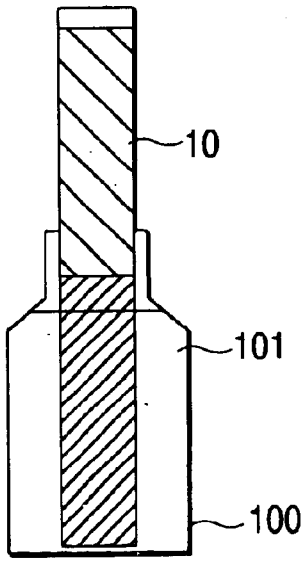
FIG. 2 schematically illustrates a solvent immersion test on photoreceptors.

As shown in FIG. 2, the photoreceptor 10 (diameter: 30 mm; length: 325 mm) was immersed to one-third of its length in 200 ml of Isopar (from Exxon Chemicals), a carrier medium of a liquid developer, put in a 250 ml-volume plastic bottle 100 in a dark room at 23 to 25° C. and 40 to 50% RH for 1, 7 or 120 days. The part which was not immersed was wrapped in light-shielding paper. After 1-day, 7-day or 120-day immersion, elution of the photosensitive layer material was examined by observing the change of appearance of the photosensitive layer (color change and cracking) and the color change of the carrier medium (Isopar, which is essentially colorless, turns to pale red and further to brown with elution of the photosensitive layer material). Further, surface potential dark decay $Vk_5$ (%) and sensitivity $E_{100}$ ($\mu J/cm^2$) were measured with a general-purpose electrostatic test system in accordance with the following test methods to examine the influences on photoreceptor characteristics.

1) Dark Decay $Vk_5$

The photoreceptor drum was charged to about 650 V while being rotated. The drum rotation was stopped, and the surface potential was measured after 5 seconds to obtain a retention (%) based on the initial surface potential.

2) Sensitivity

The photoreceptor drum was charged in the same manner as in 1) above. On stopping the drum rotation, the drum was exposed to light of about 1.0 $\mu W/cm^2$ (on the drum surface) to record a light decay curve. The exposure ($\mu J/cm^2$) which caused surface potential decay from 600 V to 100 V was taken as $E_{100}$.

TABLE 1

| | Composition (wt %) | | | Immer- | Photoreceptor Characteristics | | | Change of |
|---|---|---|---|---|---|---|---|---|
| Example No. | Low-mol. Materials | CT Polymer | Other Binder Resin | sion Time | Dark Decay $Vk_5$ (%) | Sensitivity $E_{100}$ ($\mu J/cm^2$) | Color of Carrier | Drum's Appearance |
| 1 | 20 | 80 | none | initial | 84 | 1.8 | — | — |
| | | | | 1 d | 84 | 1.8 | colorless | none |
| | | | | 7 d | 83 | 1.8 | colorless | none |
| | | | | 120 d | 78 | 2.7 | pale red | none |
| 2 | 30 | 70 | none | initial | 87 | 1.0 | — | — |
| | | | | 1 d | 87 | 1.1 | colorless | none |
| | | | | 7 d | 85 | 1.5 | pale red | none |
| | | | | 120 d | 68 | 1.9 | pale red | color change/crack |
| 3 | 20 | 80 | none | initial | 88 | 2.0 | — | — |
| | | | | 1 d | 88 | 2.0 | colorless | none |
| | | | | 7 d | 83 | 2.4 | pale red | none |
| | | | | 120 d | 70 | 3.3 | pale red | color change/crack |
| 4 | 20 | 80 | none | initial | 86 | 2.0 | — | — |
| | | | | 1 d | 85 | 2.0 | colorless | none |
| | | | | 7 d | 80 | 2.5 | pale red | none |
| | | | | 120 d | 74 | 2.9 | pale red | color change/crack |
| 5 | 20 | 80 | none | initial | 84 | 2.0 | — | — |
| | | | | 1 d | 84 | 2.1 | colorless | none |
| | | | | 7 d | 79 | 2.8 | pale red | none |
| | | | | 120 d | 70 | 3.2 | pale red | color change/crack |
| 6 | 20 | 80 | none | initial | 87 | 2.0 | — | — |
| | | | | 1 d | 87 | 2.0 | colorless | none |
| | | | | 7 d | 75 | 2.5 | pale red | none |
| | | | | 120 d | 68 | 3.4 | pale red | color change/crack |
| 7 | 30 | 70 | none | initial | 88 | 1.5 | — | — |
| | | | | 1 d | 88 | 1.6 | colorless | none |
| | | | | 7 d | 83 | 1.8 | colorless | none |
| | | | | 120 d | 80 | 2.0 | pale red | none |
| 8 | 20 | 80 | none | initial | 87 | 2.5 | — | — |
| | | | | 1 d | 87 | 2.6 | colorless | none |
| | | | | 7 d | 85 | 2.6 | colorless | none |
| | | | | 120 d | 80 | 3.0 | pale red | none |
| 9 | 20 | 80 | none | initial | 87 | 1.0 | — | — |
| | | | | 1 d | 87 | 1.1 | colorless | none |
| | | | | 7 d | 85 | 1.3 | pale red | none |
| | | | | 120 d | 70 | 3.3 | pale red | color change/crack |

TABLE 2

| Compara. | Composition (wt %) | | | Immer- | Photoreceptor Characteristics | | | Change of |
|---|---|---|---|---|---|---|---|---|
| Example No. | Low-mol. Materials | CT Polymer | Other Binder Resin | sion Time | Dark Decay $Vk_5$ (%) | Sensitivity $E_{100}$ ($\mu J/cm^2$) | Color of Carrier | Drum's Appearance |
| 1 | 40 | 60 | none | initial | 86 | 0.9 | — | — |
| | | | | 1 d | 82 | 1.5 | pale red | none |
| | | | | 7 d | 77 | 2.3 | brown | none |
| | | | | 120 d | 69 | 4.5 | brown | color change /crack |

TABLE 2-continued

| Compara. Example No. | Composition (wt %) Low-mol. Materials | CT Polymer | Other Binder Resin | Immersion Time | Photoreceptor Characteristics Dark Decay $Vk_5$ (%) | Sensitivity $E_{100}$ ($\mu J/cm^2$) | Color of Carrier | Change of Drum's Appearance |
|---|---|---|---|---|---|---|---|---|
| 2 | 55 | none | 45 | initial | 88 | 1.0 | — | — |
| | | | | 1 d | 89 | 3.8 | pale red | color change |
| | | | | 7 d | 75 | unmeasurable | brown | color change/crack |
| | | | | 120 d | 70 | unmeasurable | brown | color change/crack |
| 3 | 45 | none | 55 | initial | 85 | 1.8 | — | — |
| | | | | 1 d | 87 | 4.0 | pale red | color change |
| | | | | 7 d | 77 | unmeasurable | brown | color change/crack |
| | | | | 120 d | 72 | unmeasurable | brown | color change/crack |
| 4 | 30 | none | 70 | initial | 88 | 3.6 | — | — |
| | | | | 1 d | 89 | 4.0 | colorless | none |
| | | | | 7 d | 75 | unmeasurable | pale red | none |
| | | | | 120 d | 70 | unmeasurable | pale red | color change/crack |
| 5 | 20 | none | 80 | initial | 88 | unmeasurable | — | — |
| | | | | 1 d | 87 | unmeasurable | colorless | none |
| | | | | 7 d | 85 | unmeasurable | colorless | none |
| | | | | 120 d | 80 | unmeasurable | pale red | none |

While the binder resins used in the photoreceptors of Examples 1, 2, 7, 8, and 9 all have the chemical structure of formula (II), in which (m+n) is 85 mol % in Examples 1 and 2, 95 mol % in Example 7, 90 mol % in Example 8, and 70 mol % in Example 9. When immersed in the carrier for 120 days, the drums of Examples 2 and 9 began to change their color and initiated cracking, making the carrier colored, but their characteristics as a photoreceptor were within practically acceptable ranges.

The chemical structures of the copolymer resins used in Examples 1 through 6, represented by formulae (II) (Examples 1 and 2), (II-1) (Example 3), (II-2) (Example 4), (II-3) (Example 5) and (II-4) (Example 6), are within the scope of the present invention in relation to the photoreceptor characteristics. It is seen that the structure of formula (II) is the most excellent of them.

The photoreceptor of Comparative Example 1, which was prepared by using the copolymer resin according to the present invention in a proportion of 60% based on the photosensitive layer, caused the carrier to turn brown, underwent color change and cracking, and showed deterioration in both dark decay rate and sensitivity when immersed in the carrier for 120 days.

In Comparative Examples 2 to 5, a polycarbonate resin well-known as PC-Z type was used as a binder resin in a varied binder resin/CTM ratio to examine the carrier influences on the drum. It is seen from the results shown in Table 2 that the immersion caused serious changes leading to deterioration of photoreceptor characteristics from the very beginning of immersion irrespective of the binder resin/CTM ratio. In Table 2, "unmeasurable" means beyond the measurement limit. The photoreceptor of Comparative Example 5 did not undergo deterioration by the carrier but failed to exhibit sensitivity from the very start of the testing.

The present invention provides a positive charging single-layer organic photoreceptor which has high resistance to an isoparaffinic solvent, i.e., a petroleum solvent used in liquid development, undergoes little elution of a CTM into the solvent, and exhibits sufficiently high sensitivity for practical use.

While the invention has been described in detail and with reference to specific examples thereof, it will be apparent to one skilled in the art that various changes and modifications can be made therein without departing from the spirit and scope thereof.

What is claimed is:

1. A positive charging single-layer organic photoreceptor for liquid development which comprises a conductive substrate having thereon a photosensitive layer containing a charge generating material, an electron transport material and an organic binder resin comprising a polymer represented by formula (I):

(I)

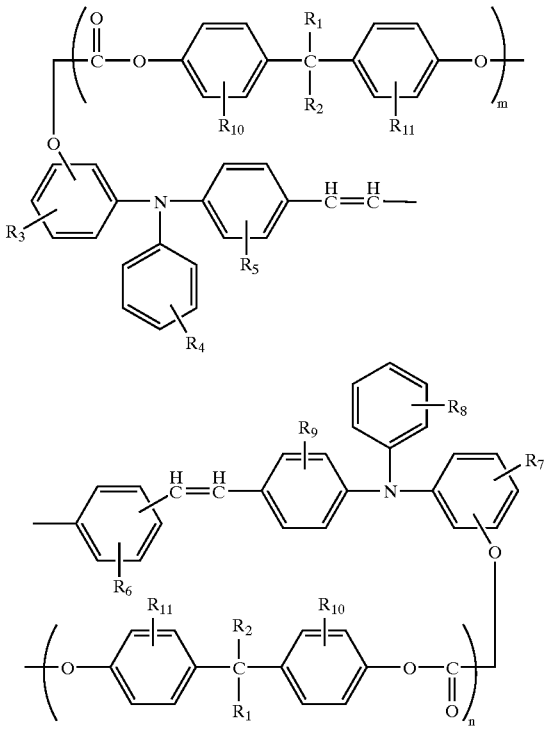

wherein $R_1$ and $R_2$ each represent a substituted or unsubstituted alkyl group or a substituted or unsubstituted aryl group, or $R_1$ and $R_2$ may form a cycloalkyl group in combination; $R_3$, $R_4$, $R_5$, $R_6$, $R_7$, $R_8$, $R_9$, $R_{10}$ and $R_{11}$ each represent a hydrogen atom, a halogen atom, an aryl group or an alkyl group; and m and n each represent a molar percentage giving a total of 70 to 95 mol %.

2. The positive charging single-layer organic photoreceptor for liquid development according to claim 1, wherein said photosensitive layer contains metal-free phthalocyanine.

3. The positive charging single-layer organic photoreceptor for liquid development according to claim 1, wherein said photosensitive layer contains titanyl phthalocyanine.

4. The positive charging single-layer organic photoreceptor for liquid development according to claim 1, wherein said photosensitive layer contains a hole transport material.

5. The positive charging single-layer organic photoreceptor for liquid development according to claim 4, wherein the total content of said hole transport material and the component functioning for hole transport in said polymer represented by formula (I) is larger than the content of said electron transport material.

6. The positive charging single-layer organic photoreceptor for liquid development according to claim 1, wherein said polymer represented by formula (I) is represented by formula (II), wherein m and n give a total of 80 to 90 mol %

(II)

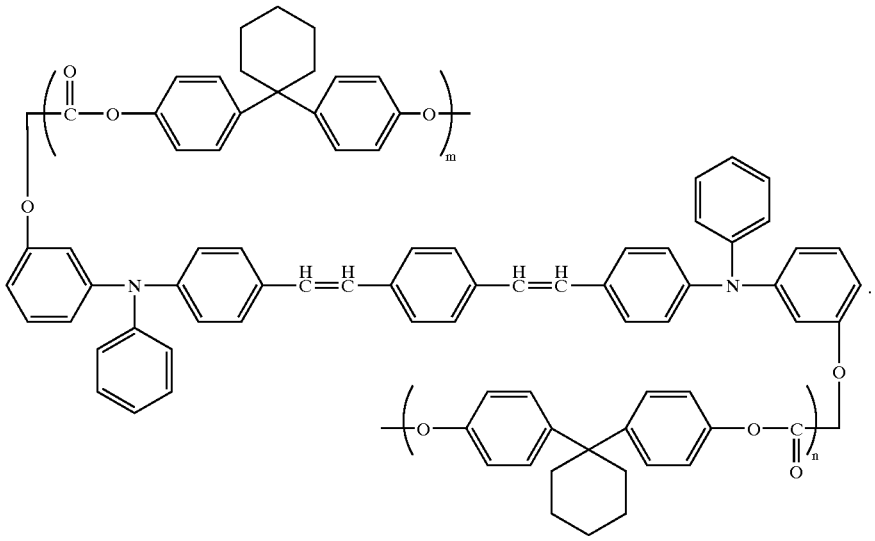

7. The positive charging single-layer organic photoreceptor for liquid development according to claim 1, wherein the content of said polymer in said photosensitive layer is 70% by weight or more.

* * * * *